US005405188A

United States Patent [19]

Hanson

[11] Patent Number: 5,405,188

[45] Date of Patent: Apr. 11, 1995

[54] MECHANICAL CHAIR

[75] Inventor: Richard W. Hanson, Sherwood, Oreg.

[73] Assignee: MDT Corporation, Torrance, Calif.

[21] Appl. No.: 140,249

[22] Filed: Oct. 21, 1993

[51] Int. Cl.[6] ..... A61G 15/00

[52] U.S. Cl. ..... 297/340; 297/322; 297/354.13

[58] Field of Search ..... 297/340, 341, 316, 322, 297/354.13

[56] References Cited

U.S. PATENT DOCUMENTS 4,362,336 12/1982 Zapf et al. ..... 297/317
4,452,486 6/1984 Zapf et al. ..... 297/341
4,572,573 2/1986 Yoshikawa et al. ..... 297/340

*Primary Examiner*—F. Daniel Lopez
*Attorney, Agent, or Firm*—Trask, Britt & Rossa

[57] ABSTRACT

An adjustable chair, such as a dental patient chair includes a chair back pivotally connected to a frame and mechanically linked to a travelling seat assembly so that as the chair back is pivoted, the distance between the back and seat assembly increases as the back is moved to an upright orientation and deceases as the back is moved to a reclined orientation. Linkage between the back and seat assembly may include a plate connected to rotate on an axis as the back is pivoted, and eccentrically connected to the travelling seat assembly.

28 Claims, 3 Drawing Sheets

MECHANICAL CHAIR

BACKGROUND OF THE INVENTION

1. Field

This invention relates to mechanical chairs of the type used by providers of professional services, and is particularly directed to such chairs having chair backs that pivot relative to chair seats.

2. Art

Many personal service professions, such as those providing personal grooming, physical therapy, medical and dental services, utilize chairs which are mechanically adjustable. The back of such a chair typically pivots with respect to an associated seat. It is common for chair back and seat arrangements of this kind to be mounted on a pedestal base and to be associated with apparatus for adjusting the elevations and relative positions of the chair seat and back. Dental patient chairs are representative of this class of personal services chair.

Certain personal services chairs are arranged so that the chair seat supports the entire lower body of an individual. The seat moves longitudinally as the chair back is pivoted with respect to the chair seat. Relative movements of the seat and back can cause discomfort to one seated in the chair, particularly as the chair is "reclined."

For example, as a dental patient chair back rotates with respect to the chair seat, the patient in the chair may feel stretched or compressed to some degree. This sensation occurs because the rotation of the chair back about a fixed pivot point relative to the seat back actually does slightly stretch or compress the lower portion of the body relative to the upper part of the body. Unless the patient repositions his body in the chair during such movement, he may experience some discomfort or irritation. In an operatory environment, it is important to avoid imposing stresses of this kind on a patient.

SUMMARY OF THE INVENTION

The adjustable chair of this invention generally is structured around a support base. A chair back is pivotally mounted with respect to the support base, the chair back having a lower edge when the back is placed in an upright orientation. This lower edge rotates around a fixed axis, but ordinarily constitutes the most stationary portion of the back throughout its range of pivotal movement. It is thus a convenient reference feature in considering the relative position of the chair seat with respect to the chair back.

According to this invention, the chair seat is mounted on the support base by means of a traveling support structure. The traveling structure may be included in a seat assembly. In any event, the traveling structure is constructed and arranged to permit travel of the seat in an approximately horizontal plane with respect to the support base, selectively towards and away from the lower edge of the chair back. Linkage mechanism connected between the chair back and the traveling structure is constructed and arranged to effect horizontal travel of the chair seat in response to pivotal movement of the chair back. In this fashion, the spacing between the lower edge and the chair seat is caused to decrease as the chair back is moved towards a horizontal orientation and to increase as the chair back is moved towards an upright orientation.

The linkage mechanism typically includes a connecting member rotatably mounted with respect to the base support on a fixed axis following the first occurrence of "axis". Structurally, the fixed axis is usually congruent with an axle integral with, or otherwise fixed to, the connecting member. The connecting member is appropriately linked to the chair back and the traveling support structure to translate pivoting motion of the chair back to horizontal longitudinal motion of the traveling structure. According to one form of the invention, a first linking member is pivotally connected at a first end to the chair back and is pivotally connected at a second end to the connecting member at a location spaced from the fixed axis of the connecting member. A second linking member is constructed and arranged to effect an eccentric connection of the traveling structure to the connecting member.

One suitable connecting member comprises a pivot plate mounted on a central axle to be rotatable with respect to the support base. The pivot plate may include an integral or attached arm projecting from the pivot plate. The first linking member may then comprise a link element pivotally connected to the chair back and also pivotally connected to the arm. This arrangement translates pivoting of the chair back on the support base into rotation of the pivot plate.

The traveling structure may be constructed as an assembly including a support pan for the chair seat. In such arrangements, the support pan is pivotally connected to the connecting member at a location spaced from the connecting member's fixed axis and from the connection point (second end) of the first linking member. Pivoting of the chair back on the support to rotate the pivot plate thereby causes movement of the traveling structure towards or away from the lower edge of the chair back, depending upon the direction of rotation of the pivot plate.

Preferably, the linkage mechanism includes a pair of linkage assemblies connected between the chair back and the traveling structure at opposite sides of the chair. Each linkage assembly may include a connecting member rotatably mounted with respect to the base support on a fixed axis, the connecting members having a common fixed axis. Each assembly may be otherwise structured to include the links and other structural features of a complete linkage mechanism.

The chair back may be manually or mechanically pivoted. A presently preferred arrangement includes hydraulic means structurally arranged with respect to the support base to effect pivotal movement of the chair back. The hydraulic means typically comprises a hydraulic cylinder operably connected between the support base and a yoke, the yoke being connected to the chair back and the connecting member. Accordingly, movement of the yoke effects rotation of the connecting member and the chair back about their respective fixed axes. The yoke may be connected to the chair back by structure comprising a link pivotally connected at a first link end to the chair back and at a second link end to the yoke. The yoke may be attached to a connecting member by structure comprising an arm attached at a first end to the connecting member and pivotally attached at a second end to the yoke. In the preferred embodiment, the second ends of a link and an arm are attached to a yoke in such a way that they pivot around a common axis. In embodiments which organize the connecting member as a pair of assemblies, the yoke may be connected to the chair back by structure including a pair of links, and be attached to connecting members by structure including a pair of arms.

The present invention avoids the stretching and compressing sensations commonly experienced by a patient installed in a dental patient chair having a chair back that pivots with respect to a chair seat. The chair seat is moved a relatively small horizontal distance, typically about 1 to about 3 inches, with respect to the relatively large simultaneous movement of the chair back. A single hydraulic cylinder and return spring assembly may be used to pivot the chair back and to move the chair seat in a coordinated fashion appropriate to assure patient comfort.

The movement of the chair seat relative to the chair back moves the lower body of a patient in the chair a short distance, preferably about two inches, longitudinally as the chair back rotates the upper body of a patient.

As the chair back pivots to a lowered position, the chair seat is moved longitudinally towards the chair back. A patient in the chair during such downward pivoting of the back does not feel stretched. Similarly, as the chair back is pivoted to a more upright position, the chair seat moves longitudinally a corresponding distance away from the chair back. In this instance, the patient in the chair does not feel compressed.

BRIEF DESCRIPTION OF THE DRAWINGS

In the drawings, which illustrate what is currently regarded as the best mode for carrying out the invention.

DESCRIPTION OF THE ILLUSTRATED EMBODIMENT

Figure 1:
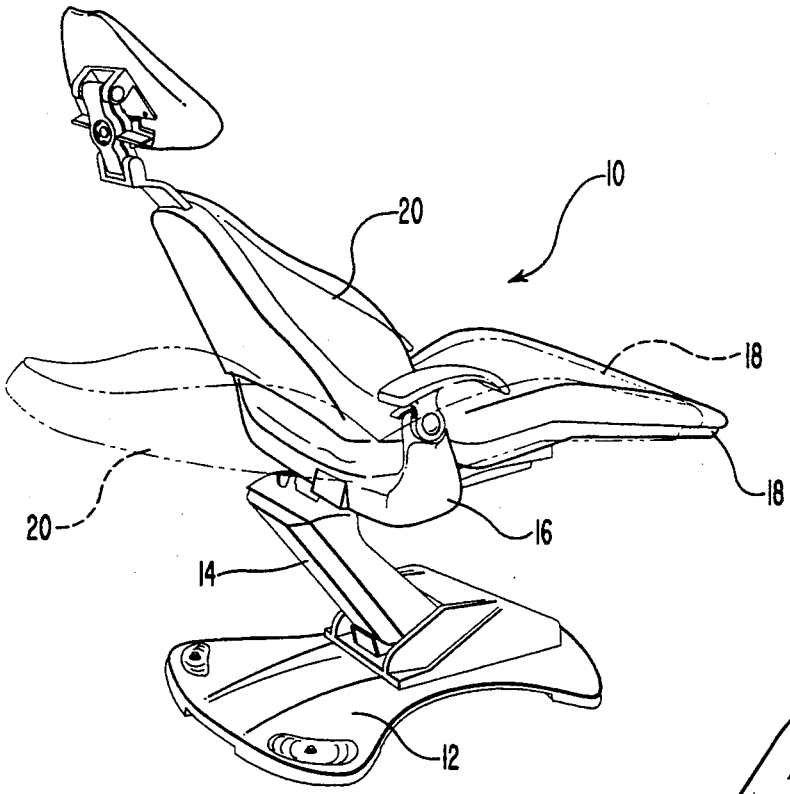
FIG. 1 is a perspective view, taken from the rear and at one side of a dental patient chair embodying the invention, an alternative positioning of the back of the chair being shown by phantom lines.

A dental patient chair, designated generally 10, includes a pedestal base 12. A support frame structure 14 extends up from the base 12 to carry a frame, designated generally 16, which in turn supports a chair seat 18 and a chair back 20. FIG. 1 illustrates the back 20 in a substantially upright orientation in solid lines and in a reclined orientation in phantom lines.

A hydraulic cylinder 24 is connected by a fixture 26 to an element 16A of frame 16. A rod 30 extends from the cylinder 24, and is connected to a yoke 34. Spaced arms 36 of the yoke 34 are each pivotally connected by respective pins 37 to respective links 38 projecting down from the chair back 20. A pair of springs 39, positioned at opposite sides of the cylinder 24 and connected between the yoke 34 and element 16A of the frame 16 bias the rod 30 into retracted condition with respect to the cylinder 24.

Pivot rods 40 at the lower end of the chair back 20 are journaled in pivot connections 44 at an element 16B of frame 16. Expulsion of cylinder rod 30 from the housing 48 of hydraulic cylinder 24 pivots the chair back 20, through the links 38 and yoke 34 at the pivot connections 44. The direction of travel under these conditions is generally up. Retraction of the cylinder rod pivots the chair back down through the same linkage components.

The links 38 each are pivotally connected at one end 52 by a pin 54 to the lower end of chair back 20. The links 38 are thus movable with the back 20. The other end 56 of each link 38 is connected by a pivot pin 37 to an arm 36 of the yoke 34. Corresponding arms 58 are fixed to and project from respective circular plates 60. These arms 58 are each pivotally mounted at one end on a pivot pin 37.

Figure 2:
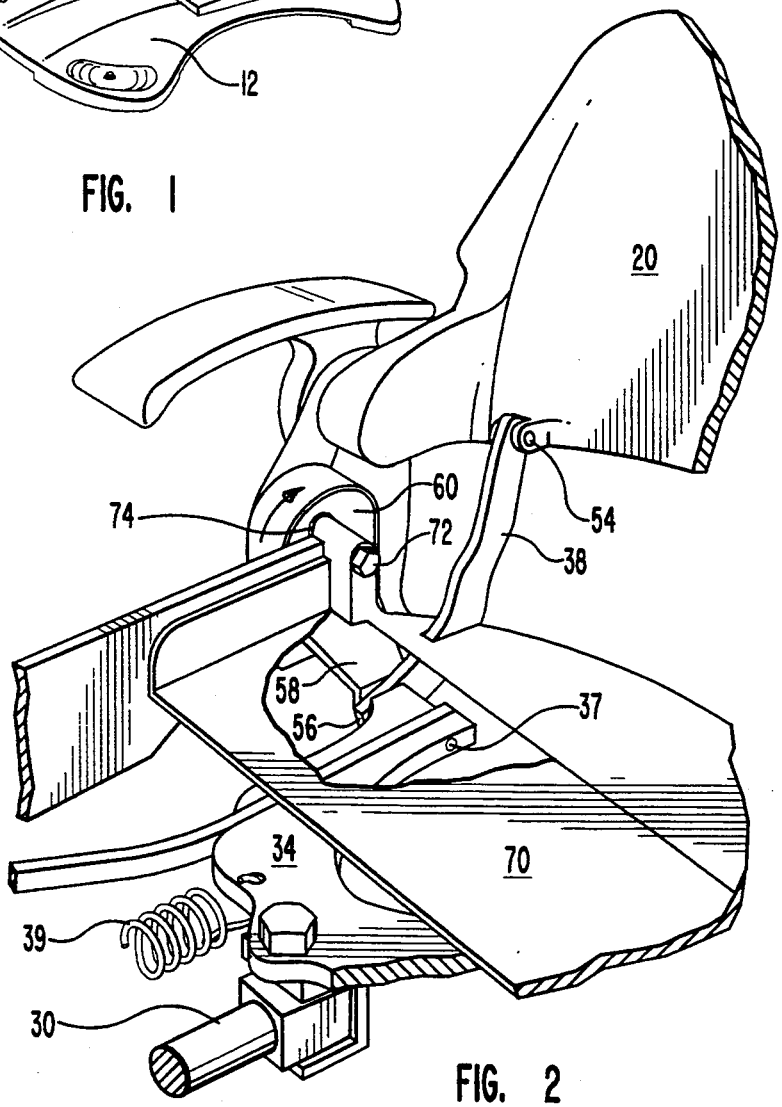
FIG. 2 is an enlarged fragmentary perspective view, showing mechanical details, of the chair of FIG. 1.
Figure 3:
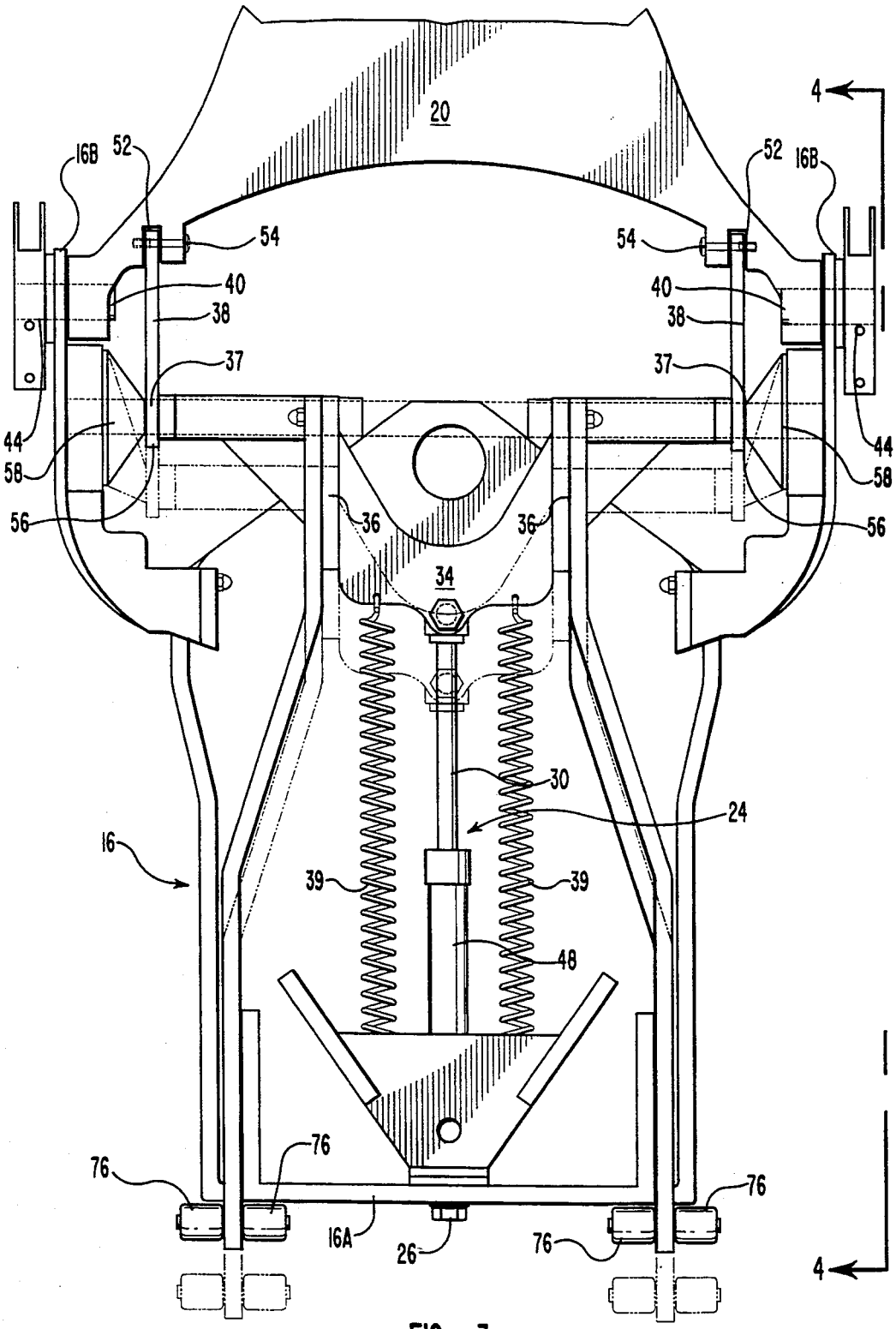
FIG. 3 is a fragmentary top plan view of the chair of FIG. 1 with both the seat and seat support components removed.
Figure 4:
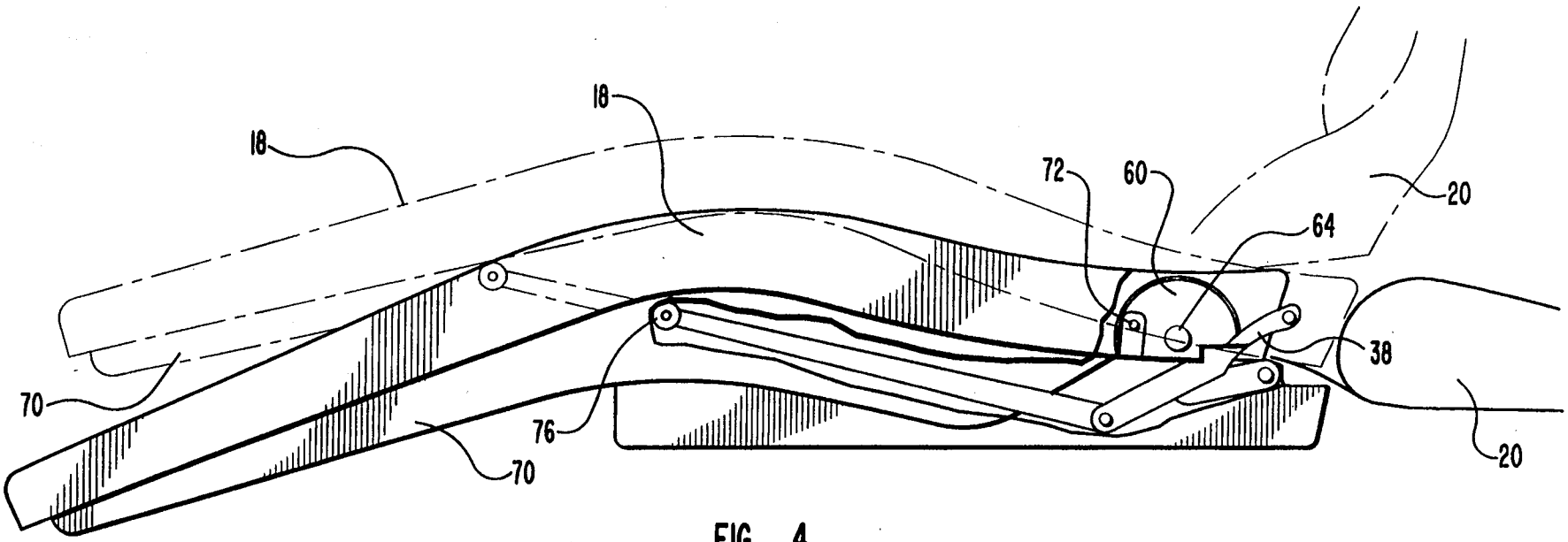
FIG. 4 is a diagrammatic view of a portion of the chair of FIG. 1, alternative positionings of major components being shown by phantom lines.

Each plate 60 is supported by a central axle 64 that is journaled at the support frame 16. Chair seat 18 rests on a seat support pan 70. FIG. 4 illustrates the pan 70 in solid lines as it is positioned with the seat back 20 in reclined orientation and in phantom lines as it is positioned with the back 20 in upright orientation. As best shown by FIGS. 2 and 3, pins 72 project from opposite sides of the pan 70, and extend into holes 74 provided in the plates 60. The holes 74 are offset from the central axle 64.

Each arm 58 is pivotally connected to a pivot pin 37, along with an arm 38. Thus, as the arms 38 swing with the pivoting of the chair back 20 in response to actuation of the hydraulic cylinder 24, the plates 60 are rotated on their pivot axles 64. This rotation effects a movement of the seat pan 70, which is eccentrically connected by pins 72 to the plates 60.

As the chair back 20 is pivoted to a more upright position by expulsion of rod 30 of the hydraulic cylinder 24, the links 38 inevitably effect a corresponding pivoting of arms 58, and thus a corresponding rotation of plates 60. This rotation of plates 60 repositions the holes 74 in plates 60,and thus the pins 72, to move the seat pan 70, and thus the seat 18, away from the chair back 20. Conversely, rotation of the chair back 20 to a lowered position results in a reverse rotation of the plate 60, thereby effecting movement of the seat pan 70, and thus the seat 18 towards the chair back 20.

The chair seat 18 rests on seat pan 70. Pivot pins 72 carry one end of the seat pan 70, and another end of the pan 70 rests on rollers 76 that are mounted on frame 16.

In operation of the dental chair 10, cylinder 24 is operated to expel rod 30. The yoke 34 is thereby moved, and through links 38 rotates the chair back 20 to a raised position. At the same time, the movement of the yoke 34 pivots arms 58 and rotates the plates 60 to which the arms 58 are attached around the central pivot axis 64. Rotation of the plates 60 in response to expulsion of rod 30 also turns the pivot pins 70, and moves the seat pan 70 and chair seat carried thereby away from the seat back 20.

Retraction of rod 30 by springs 39 pivots the chair seat to a lowered position. At the same time the retraction of the rod moves the yoke 34 and through arms 58, pivots the plates 60 to turn the pivot pins 70 such that the seat pan 70 and chair seat 18 are moved towards the seat back 20. The amount of seat movement is determined by the offset positioning of the pivot pins 70 from the pivot axis 64 of the plates 60. The presently preferred embodiments provide for about 1½ to about 2½ inches of such movement.

While the illustrated embodiment of the invention has been described in detail, the appended claims are intended to encompass equivalent structures, without regard to the particular environment of use appropriate for various other specific embodiments.

What is claimed is:

1. An adjustable chair, comprising:

a support base;

a chair back having a lower edge, said back being pivotally mounted in the proximity of said lower edge around a first axis, which is fixed with respect to said support base, whereby movement of said lower edge is limited to rotation around said first fixed axis;

a chair seat mounted on said support base by traveling structure, said traveling structure being constructed and arranged to permit travel of said seat in an approximately horizontal plane with respect to said support base, selectively towards and away from said lower edge; and linkage mechanism connected between said chair back and said traveling structure, said linkage mechanism being constructed and arranged to effect horizontal travel of said chair seat in response to pivotal movement of said chair back; whereby the spacing between said lower edge and said chair seat is caused to decrease as said chair back is moved towards a horizontal orientation and to increase as said chair back is moved towards an upright orientation.

2. A chair according to claim 1, wherein said linkage mechanism comprises:

a connecting member rotatably mounted with respect to said support base on a second axis fixed with respect to said support base;

a first linking member pivotally connected at a first end to said chair back and pivotally connected at a second end to said connecting member at a location spaced from said second axis; and a second linking member constructed and arranged to effect an eccentric connection of said traveling structure to said connecting member.

3. A chair according to claim 2, wherein:

said connecting member comprises a pivot plate and a central axle constructed and arranged so that said plate is rotatable with respect to said support base, and an arm projecting from said pivot plate; and said first linking member comprises:

a link connected to said chair back and pivotally connected to said arm, whereby pivoting of said chair back on said support base rotates said pivot plate.

4. A chair according to claim 2 wherein said traveling structure comprises a support pan for said chair seat, and said support pan is pivotally connected to said connecting member at a location spaced frown said second axis and from said second end of said first linking member.

5. A chair according to claim 4, wherein:

said connecting member comprises a pivot plate with a central axle rotatable with respect to said support base and an arm projecting from said pivot plate; and said first linking member comprises:

a link connected to said chair back and pivotally connected to said arm, whereby pivoting of said chair back on said support base rotates said pivot plate; whereby rotation of said pivot plate causes movement of said traveling structure towards or away from said lower edge of said chair back, depending upon the direction of rotation of said pivot plate.

6. A chair according to claim 2, further including:

hydraulic means structurally arranged with respect to said support base to effect pivotal movement of said chair back.

7. A chair according to claim 6, wherein:

said hydraulic means comprises a hydraulic cylinder operably connected between said support base and a yoke, said yoke being connected to said chair back and said connecting member, whereby movement of said yoke effects rotation of said connecting member about said second axis.

8. A chair according to claim 7, wherein:

said connecting member comprises a pivot plate with a central axle rotatable with respect to said support base and an arm projecting from said pivot plate; and said first linking member comprises:

a link connected to said chair back and pivotally connected to said arm, whereby pivoting of said chair back on said support base rotates said pivot plate.

9. A chair according to claim 7 wherein said traveling structure comprises a support pan for said chair seat, and said support pan is pivotally connected to said connecting member at a location spaced from said second axis and from said second end of said first linking member.

10. A chair according to claim 9, wherein:

said connecting member comprises a pivot plate with a central axle rotatable with respect to said support base and an arm projecting from said pivot plate; and said first linking member comprises:

a link connected to said chair back and pivotally connected to said arm, whereby pivoting of said chair back on said support base rotates said pivot plate; whereby rotation of said pivot plate causes movement of said traveling structure towards or away from said lower edge of said chair back, depending upon the direction of rotation of said pivot plate.

11. A chair according to claim 7, wherein said yoke is connected to said chair back by said first linking member and to said travel structure by said connecting member.

12. A chair according to claim 11, wherein:

said connecting member comprises a pivot plate with a central axle rotatable with respect to said support base and an arm connected at a first end to said pivot plate at a location spaced from said central axle, said arm pivotally connected at a second end to said yoke; and said first linking member comprises:

a link pivotally connected to said chair back at a first end and pivotally connected at a second end to said second end of said arm and to said yoke at a fixed axis common to said link, said arm, and said yoke, whereby actuating said hydraulic means pivots said chair back on said support base and rotates said pivot plate, and rotation of said pivot plate causes movement of said traveling structure towards or away from said lower edge of said chair back, depending upon the direction of rotation of said pivot plate.

13. A chair according to claim 6, wherein said linkage mechanism includes a pair of linkage assemblies connected between said chair back and said traveling structure at opposite sides of said chair, said linkage assemblies each comprising:

a connecting member rotatably mounted with respect to said support base on said second axis, both said connecting members having the same said second axis;

a first linking member pivotally connected at a first end to said chair back and pivotally connected at a second end to said connecting member at a location spaced from said second axis; and a second linking member constructed and arranged to effect an eccentric connection of said traveling structure to said connecting member.

14. A chair according to claim 13, wherein:

each said connecting member comprises a pivot plate with a central axle rotatable with respect to said support base and an arm projecting from a respective said pivot plate; and each of said first linking members comprises:

a link connected to said chair back and pivotally connected to said arm, whereby pivoting of said chair back on said support base rotates said respective pivot plate.

15. A chair according to claim 13 wherein said traveling structure comprises a support pan for said chair seat, and said support pan is pivotally connected to said connecting members at respective locations spaced from said second axis and from said second end of a respective said first linking member.

16. A chair according to claim 15, wherein:

each said connecting member comprises a pivot plate with a central axle rotatable with respect to said support base and an arm projecting from a respective said pivot plate; and each said first linking member comprises:

a link connected to said chair back and pivotally connected to said arm, whereby pivoting of said chair back on said support base rotates said respective pivot plate; whereby rotation of said pivot plates causes movement of said traveling structure towards or away from said lower edge of said chair back, depending upon the direction of rotation of said pivot plates.

17. A chair according to claim 16, wherein: a yoke is connected to said support base by structure comprising:

a pair of links, each said link being pivotally connected at a first link end to said chair back and at a second link end to said yoke.

18. A chair according to claim 1, wherein said linkage mechanism includes a pair of linkage assemblies connected between said chair back and said traveling structure at opposite sides of said chair, said linkage assemblies each comprising:

a connecting member rotatably mounted with respect to said support base on a second axis fixed with respect to said support base, both said connecting members rotating around the same said second axis;

a first linking member pivotally connected at a first end to said chair back and pivotally connected at a second end to said connecting member at a location spaced from said second axis; and a second linking member constructed and arranged to effect an eccentric connection of said traveling structure to said connecting member.

19. A chair according to claim 18, wherein:

each said connecting member comprises a pivot plate with a central axle rotatable with respect to said support base and an arm projecting from a respective said pivot plate; and each of said first linking members comprises:

a link connected to said chair back and pivotally connected to said arm, whereby pivoting of said chair back on said support base rotates said respective pivot plate.

20. A chair according to claim 18 wherein said traveling structure comprises a support pan for said chair seat, and said support pan is pivotally connected to said connecting members at respective locations spaced from said second fixed axis and from said second end of a respective said first linking member.

21. A chair according to claim 20, wherein:

each said connecting member comprises a pivot plate with a central axle rotatable with respect to said support base and an arm projecting from a respective said pivot plate; and each said first linking member comprises:

a link connected to said chair back and pivotally connected to said arm, whereby pivoting of said chair back on said support base rotates said respective pivot plate; whereby rotation of said pivot plates causes movement of said traveling structure towards or away from said lower edge of said chair back, depending upon the direction of rotation of said pivot plates.

22. A chair according to claim 21, wherein each said arm and respective said link are pivotally connected at respective locations to each other and to a yoke, whereby actuation means operably connected between said support base and said yoke effect rotation of said connecting member and of said chair back about their respective said first and second axes.

23. An adjustable chair according to claim 1, wherein said chair back pivots from an upright orientation to a reclined position, and the corresponding range of travel of said chair seat is between about 1 and about 3 inches.

24. An adjustable chair, comprising:

a support base;

a chair back pivotally mounted with respect to said support base, said chair back having a lower edge;

a chair seat mounted on said support base by traveling structure, said traveling structure being constructed and arranged to permit travel of said seat in an approximately horizontal plane with respect to said support base, selectively towards and away from said lower edge; and linkage mechanism connected between said chair back and said traveling structure, said linkage mechanism being constructed and arranged to effect horizontal travel of said chair seat in response to pivotal movement of said chair back; whereby the spacing between said lower edge and said chair seat is caused to decrease as said chair back is moved towards a horizontal orientation and to increase as said chair back is moved towards an upright orientation, and wherein said linkage mechanism comprises:

a connecting member rotatably mounted with respect to said support base on a fixed axis;

a first linking member connected at a first end to said chair back and connected at a second end to said connecting member at a location spaced from said fixed axis; and a second linking member constructed and arranged to effect an eccentric connection of said traveling structure to said connecting member;

hydraulic means structurally arranged with respect to said support base to effect pivotal movement of said chair back, said hydraulic means comprising a hydraulic cylinder operably connected between said support base and a yoke, said yoke being connected to said chair back and said connecting member, whereby movement of said yoke effects rotation of said connecting member about said fixed axis; and said yoke is connected to said support base by structure comprising:

a link pivotally connected at a first link end to said chair back and at a second link end to said yoke.

25. A chair, wherein chair seat travel relative to a chair back is effected by pivoting of said chair back comprising:

a support base;

a chair back carried by said support base and having a lower edge, wherein the range of motion of said lower edge is limited to rotation around a fixed axis with respect to said support base;

a chair seat carried by said support base;

means for pivoting said chair back on said support base;

a pivot plate with a central axis, said pivot plate being rotatably mounted on said support base;

a first arm projecting from said pivot plate;

a second arm fixed to said chair back and pivotally connected to said first arm, whereby pivoting of said chair back on said support base rotates said pivot plate; and a chair seat assembly eccentrically pivotally connected to said pivot plate, whereby rotation of said pivot plate moves said chair seat assembly towards or away from said chair back, depending upon the direction of rotation of said pivot plate.

26. A chair according to claim 25, wherein the range of travel of said chair seat assembly as said chair back is pivoted from an upright orientation to a reclined orientation is between about 1 and about 3 inches.

27. A chair according to claim 26, wherein said range of travel is about 2 inches.

28. An adjustable chair, comprising:

a support base;

a chair back pivotally mounted with respect to said support base, said chair back having a lower edge;

a chair seat mounted on said support base by traveling structure, said traveling structure being constructed and arranged to permit travel of said seat in an approximately horizontal plane with respect to said support base, selectively towards and away from said lower edge; and linkage mechanism connected between said chair back and said traveling structure, said linkage mechanism being constructed and arranged to effect horizontal travel of said chair seat in response to pivotal movement of said chair back and further comprising a pair of linkage assemblies connected between said chair back and said traveling structure at opposite sides of said chair, each said linkage assembly comprising:

a connecting member rotatably mounted with respect to said support base on a fixed axis, each said connecting member comprising a pivot plate with a central axle rotatable with respect to said support base and an arm projecting from a respective said pivot plate;

a first linking member comprising a link pivotally connected at a first end to said chair back and pivotally connected at a second end to said arm at a location spaced from said fixed axis, whereby pivoting of said chair back on said support base rotates said respective pivot plate and rotation of said pivot plates causes movement of said lower edge of said chair back, depending upon the direction of rotation of said pivot plates, and the spacing between said lower edge and said chair seat is thereby caused to decrease as said chair back is moved towards a horizontal orientation and to increase as said chair back is moved towards an upright orientation; and a second linking member constructed and arranged to effect an eccentric connection of said traveling structure to a said connecting member;

hydraulic means structurally arranged with respect to said support base to effect pivotal movement of said chair back;

said traveling structure comprising a support pan for said chair seat, wherein said support pan is pivotally connected to each said connecting members at respective locations spaced from said fixed axis and from said second ends of respective said first linking members; and said yoke being connected to said support base by structure comprising:

a pair of links, each said link being pivotally connected at a first link end to said chair back and at a second link end to said yoke.

* * * * *